US008228321B2

(12) United States Patent
Kim et al.

(10) Patent No.: US 8,228,321 B2
(45) Date of Patent: Jul. 24, 2012

(54) APPARATUS FOR ADJUSTING LUMINANCE, DISPLAY DEVICE HAVING THE SAME AND METHOD OF ADJUSTING LUMINANCE

(75) Inventors: Young Kim, Seoul (KR); Young-Joo Park, Hwaseong-si (KR); Hoe-Woo You, Seoul (KR)

(73) Assignee: Samsung Electronics Co., Ltd., Suwon-Si, Gyeonggi-Do (KR)

( * ) Notice: Subject to any disclaimer, the term of this patent is extended or adjusted under 35 U.S.C. 154(b) by 1185 days.

(21) Appl. No.: 12/037,575

(22) Filed: Feb. 26, 2008

(65) Prior Publication Data

US 2008/0211762 A1 Sep. 4, 2008

(30) Foreign Application Priority Data

Mar. 2, 2007 (KR) ..... 10-2007-0020787

(51) Int. Cl.
*G09G 5/00* (2006.01)

(52) U.S. Cl. ..... 345/207; 345/102

(58) Field of Classification Search ..... 345/87–102, 345/207; 250/214–216
See application file for complete search history.

(56) References Cited

U.S. PATENT DOCUMENTS

| | | | | |
|---|---|---|---|---|
| 4,294,513 | A * | 10/1981 | Nelson et al. | 385/4 |
| 6,147,664 | A * | 11/2000 | Hansen | 345/74.1 |
| 7,663,596 | B2 * | 2/2010 | Nam et al. | 345/102 |
| 2005/0012471 | A1 * | 1/2005 | Burau et al. | 315/291 |
| 2007/0126656 | A1 * | 6/2007 | Huang et al. | 345/46 |
| 2007/0236438 | A1 * | 10/2007 | Sung | 345/88 |
| 2007/0279369 | A1 * | 12/2007 | Yao et al. | 345/102 |
| 2008/0158642 | A1 * | 7/2008 | Hsu | 359/273 |
| 2009/0179880 | A1 * | 7/2009 | Nakajima et al. | 345/207 |
| 2009/0237381 | A1 * | 9/2009 | Otani et al. | 345/207 |
| 2010/0117940 | A1 * | 5/2010 | Wu et al. | 345/84 |

* cited by examiner

*Primary Examiner* — Ke Xiao
*Assistant Examiner* — Rodney Amadiz
(74) *Attorney, Agent, or Firm* — F. Chau & Associates, LLC

(57) ABSTRACT

An apparatus for adjusting luminance includes a comparing part, a summing part, a mode selecting part, an inverting part and a decoding part. The comparing part compares a photo sensing voltage with a reference voltage in each of a plurality of sensing periods and generating a photo sensing signal. The summing part sums the photo sensing signal during the sensing periods and generates a plurality of summation signals. The mode selecting part controls an application of the summation signals based on a mode selection. Then, the inverting part inverts the summation signals based on the control of the mode selecting part and generates a plurality of inversion signals. The decoding part decodes the summation signals or the inversion signals and generates a decoding signal. Therefore, light pollution and power consumption may be decreased, and manufacturing costs may be decreased.

21 Claims, 9 Drawing Sheets

APPARATUS FOR ADJUSTING LUMINANCE, DISPLAY DEVICE HAVING THE SAME AND METHOD OF ADJUSTING LUMINANCE

CROSS-REFERENCE TO RELATED APPLICATION

The present application claims priority under 35 U.S.C. §119 to Korean Patent Application No. 10-2007-0020787, filed on Mar. 2, 2007 in the Korean Intellectual Property Office (KIPO), the contents of which are hereby incorporated by reference herein as set forth in their entirety.

BACKGROUND OF THE INVENTION

1. Technical Field

The present invention relates to adjusting luminance, and more particularly, to an apparatus for adjusting luminance, a display device having the apparatus for adjusting the luminance and a method of adjusting the luminance.

2. Discussion of the Related Art

Flat panel display devices have various characteristics such as being thin, light weight, small, etc., and are thus widely used in various fields such as mobile devices.

A liquid crystal display (LCD) device is a type of a flat panel display device. An LCD device displays an image using liquid crystal that is a non-emissive type display element. Thus, the LCD device requires a backlight assembly.

Suitable backlight assemblies may consume a relatively high amount of power and thus, providing for the necessary power supply decreases the portability of a device utilizing an LCD.

In addition, the brightness associated with LCD backlight assemblies may create light pollution when the display device is activated in a space requiring low luminance such as a theater, a seminar room, etc.

SUMMARY OF THE INVENTION

Exemplary embodiments of the present invention provide an apparatus for adjusting luminance, which is capable of decreasing light pollution and power consumption.

In addition, exemplary embodiments of the present invention also provide a display device having the above-mentioned apparatus for adjusting the luminance.

Furthermore, exemplary embodiments of the present invention provides a method of adjusting the luminance, which is capable of decreasing the light pollution and the power consumption.

An apparatus for adjusting luminance in accordance with an aspect of the present invention includes a comparing part, a summing part, a mode selecting part, an inverting part and a decoding part. The comparing part compares a photo sensing voltage with a reference voltage in each sensing period to generate a photo sensing signal. The summing part sums the photo sensing signal during a plurality of the sensing periods to generate a plurality of summation signals. The mode selecting part controls an application of the summation signals based on a mode selection. Then, the inverting part inverts the summation signals based on the control of the mode selecting part to generate a plurality of inversion signals. The decoding part decodes the summation signals or the inversion signals to generate a decoding signal. The apparatus for adjusting luminance may further include a sensing part that senses an external luminance level and generates a preliminary sensing current, and a smoothing part integrating the preliminary sensing current in the each sensing period and generating the photo sensing voltage.

An apparatus for adjusting luminance in accordance with an aspect of the present invention includes a comparing part, a summing part, a decoding part, a mode selecting part and an inverting part. The comparing part compares a photo sensing voltage with a reference voltage in each sensing period to generate a photo sensing signal. The summing part sums the photo sensing signal during a plurality of the sensing periods to generate a plurality of summation signals. The decoding part decodes the summation signals to output a decoding signal. The mode selecting part controls an application of the decoding signal based on a mode selection. The inverting part inverts the decoding signal based on the control of the mode selecting part to generate an inversion signal.

A display device in accordance with an aspect of the present invention includes a display panel, a backlight assembly and a luminance adjusting unit. The display panel displays an image. The backlight assembly is disposed under the display panel and supplies the display panel with light. The luminance adjusting unit includes a comparing part, a summing part, a mode selecting part, an inverting part and a driving element. The comparing part compares a photo sensing voltage with a reference voltage in each sensing period to generate a photo sensing signal. The summing part sums the photo sensing signal during a plurality of the sensing periods to generate a plurality of summation signals. The mode selecting part controls an application of the summation signals based on a mode selection. The inverting part inverts the summation signals based on the control of the mode selecting part to generate a plurality of inversion signals. The driving element controls a driving current of the backlight assembly based on the summation signals or the inversion signals.

A method of adjusting luminance in accordance with an aspect of the present invention is provided as follows. An external luminance level of a display device is sensed to generate a preliminary sensing current. The preliminary sensing current is integrated in each sensing period to generate a photo sensing voltage. The photo sensing voltage is compared with a reference voltage in the sensing periods to generate a photo sensing signal. The photo sensing signal is summed during a plurality of the sensing periods to generate a plurality of summation signals. The summation signals are inverted based on a mode selection to generate a plurality of inversion signals. The summation signals or the inversion signals are decoded to output a decoding signal.

A method of adjusting luminance in accordance with an aspect of the present invention is provided as follows. An external luminance level of a display device is sensed to generate a preliminary sensing current. The preliminary sensing current is integrated in each sensing period to generate a photo sensing voltage. The photo sensing voltage is compared with a reference voltage in the sensing periods to generate a photo sensing signal. The photo sensing signal is summed during a plurality of the sensing periods to generate a plurality of summation signals. The summation signals are decoded to output a decoding signal. The decoding signal is inverted based on a mode selection to generate an inversion signal. A driving current having a level corresponding to the decoding signal or the inversion signal is generated.

According to an apparatus for adjusting the luminance, a display device having the apparatus for adjusting the luminance and the method of adjusting the luminance according to an exemplary embodiment of the present invention, the apparatus for adjusting the luminance includes a mode selecting part to be commonly used in a transflective-type display panel and a transmissive-type display panel.

When the transmissive-type display panel includes the apparatus for adjusting the luminance, the luminance of a light source may be decreased as external luminance is decreased. Thus, light pollution and power consumption may be decreased in a dark place.

Furthermore, the mode selecting part and an inverting part may have simple structures, so that defects and manufacturing costs of the apparatus for adjusting the luminance may be decreased.

BRIEF DESCRIPTION OF THE DRAWINGS

The above and other aspects of the present invention will become more apparent by describing in detail example embodiments thereof with reference to the accompanying drawings, in which.

DETAILED DESCRIPTION OF EXEMPLARY EMBODIMENTS

Figure 1:
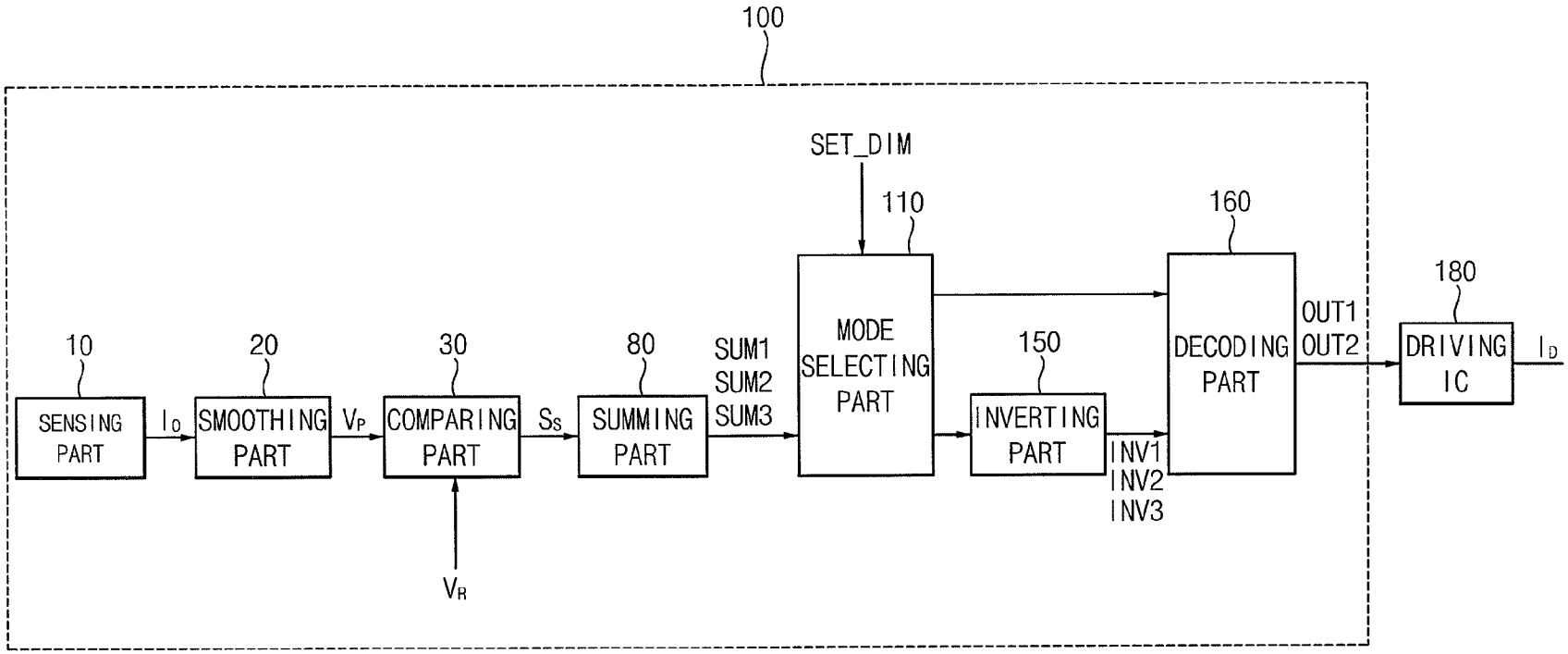
FIG. 1 is a block diagram illustrating an apparatus for adjusting luminance in accordance with an exemplary embodiment of the present invention.

Exemplary embodiments of the present invention are described more fully hereinafter with reference to the accompanying drawings. This invention may, however, be embodied in many different forms and should not be construed as limited to the exemplary embodiments set forth herein. In the drawings, the size and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. It will be understood that, although the terms first, second, third etc. may be used herein to describe various elements, components, regions, layers and/or sections, these elements, components, regions, layers and/or sections should not be limited by these terms.

Figure 2:
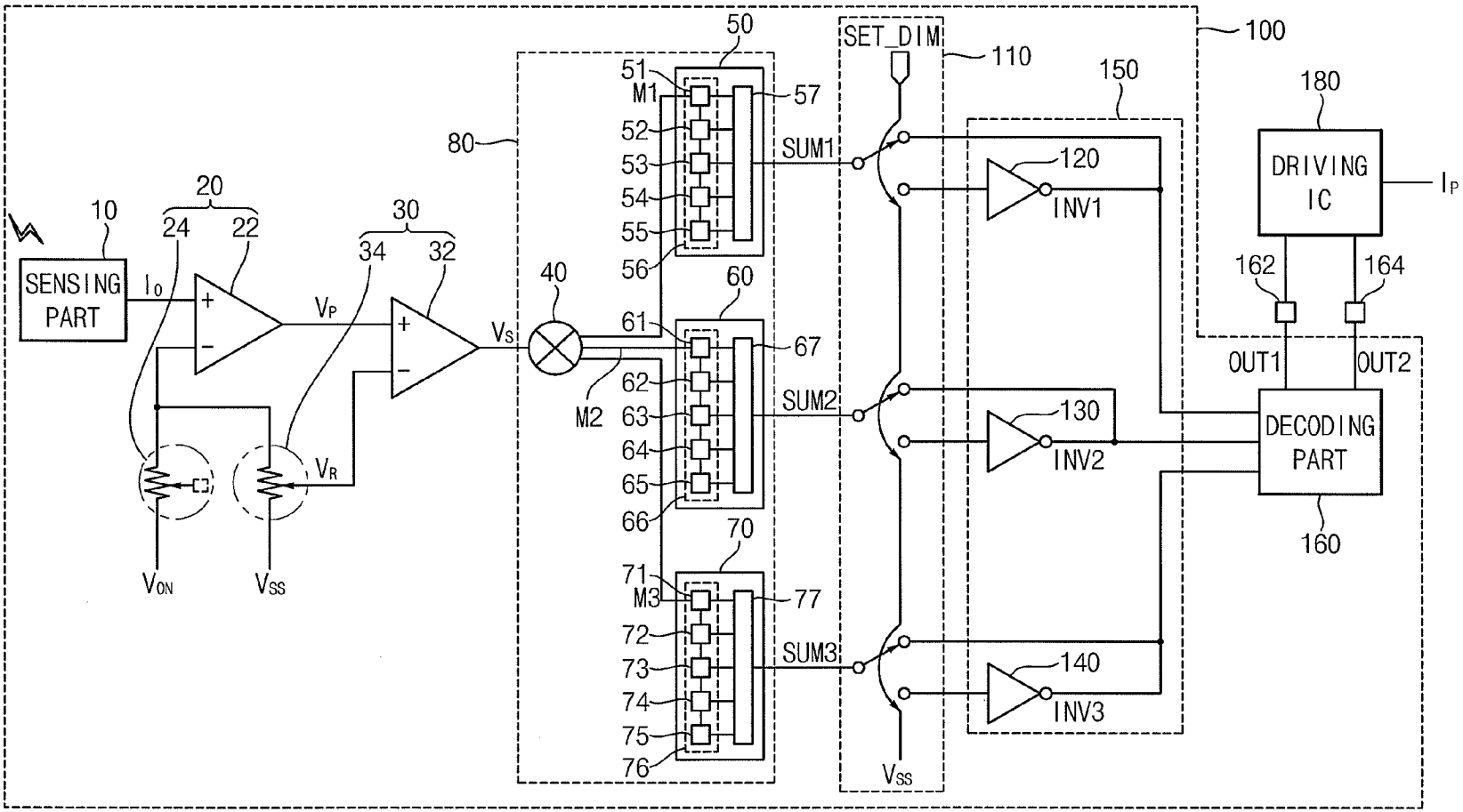
FIG. 2 is a circuit diagram illustrating the apparatus for adjusting the luminance shown in FIG. 1.

FIG. 1 is a block diagram illustrating an apparatus for adjusting luminance in accordance with an exemplary embodiment of the present invention. FIG. 2 is a circuit diagram illustrating the apparatus for adjusting the luminance shown in FIG. 1.

Referring to FIGS. 1 and 2, the apparatus 100 for adjusting the luminance includes a sensing part 10, a smoothing part 20, a comparing part 30, a summing part 80, a mode selecting part 110, an inverting part 150 and a decoding part 160. The apparatus 100 for adjusting the luminance is electrically connected to a driving integrated circuit (IC) 180. Alternatively, the driving IC 180 may be integrally formed with the apparatus 100 for adjusting the luminance. For example, the driving IC 180 may include a digital-to-analog converter (DAC).

The sensing part 10 includes a photo sensor (not shown). In FIGS. 1 and 2, the sensing part 10 includes a plurality of photo sensors (not shown) disposed on an array substrate. For example, the photo sensors may be formed on the array substrate through a thin film deposition process. A preliminary sensing current $I_0$ generated from the sensing part 10 is applied to the smoothing part 20.

The smoothing part 20 includes an integrator 22 and a sensing period determining part 24.

The integrator 22 integrates the preliminary sensing current $I_0$ that is applied to the integrator 22 in each sensing period and outputs a plurality of light-sensing voltages VP respectively corresponding to the sensing periods, in sequence. The preliminary sensing current $I_0$ is applied to the integrator 22 through a first electrode (+) of the integrator 22, and a control signal outputted from the sensing period determining part 24 is applied to a second electrode (−) of the integrator 22.

The sensing period determining part 24 determines the length of each of the sensing periods. In FIGS. 1 and 2, the sensing periods are substantially the same, and each of the sensing periods is on the order of tens of milliseconds. For example, each of the sensing periods may be about 6.7 ms.

The comparing part 30 includes a comparator 32 and a reference voltage generating circuit 34. The comparator 32 compares each of the photo sensing voltages $V_P$ applied to the comparator 32 during each of the sensing periods and a reference voltage $V_R$.

In FIGS. 1 and 2, each of the photo sensing voltages $V_P$ are applied to a first electrode (+) of the comparator 32, and the reference voltage $V_R$ is generated from the reference voltage generating circuit 34 and is applied to a second electrode (−) of the comparator 32. For example, when the photo sensing voltage $V_P$ is greater than the reference voltage $V_R$, the comparator 30 may output a photo sensing signal $S_S$ of a high state during the sensing period.

When the photo sensing voltage $V_P$ is smaller than the reference voltage $V_R$, the comparator 30 outputs a photo sensing signal $S_S$ of a low state during the sensing period.

Therefore, the comparator 30 outputs the photo sensing signal $S_S$ having the high state or the low state corresponding to the photo sensing voltages $V_P$ in each sensing period.

Alternatively, each of the photo sensing voltages $V_P$ may be applied to the second electrode (−) of the comparator 32, and the reference voltage $V_R$ may be applied to the first electrode (+) of the comparator 32. When the signals applied to the first and second electrodes (+) and (−) of the comparator 32 are changed, the on and off states of switching elements of the mode selecting part 110 may be changed.

The summing part 80 includes a distributing circuit 40, a first summing circuit 50, a second summing circuit 60 and a third summing circuit 70.

The distributing circuit 40 is electrically connected to the comparator 32, the first summing circuit 50, the second summing circuit 60 and the third summing circuit 70.

The first summing circuit 50 includes a first register 56 and a first summing portion 57. The first register 56 includes a first flip-flop 51, a second flip-flop 52, a third flip-flop 53, a fourth flip-flop 54 and a fifth flip-flop 55. The first register 56 stores signals applied to the first summing circuit 50, and outputs the stored signals to the first summing portion 57.

The second summing circuit 60 includes a second register 66 and a second summing portion 67. The second register 66 includes a first flip-flop 61, a second flip-flop 62, a third flip-flop 63, a fourth flip-flop 64 and a fifth flip-flop 65. The second register 66 stores signals applied to the second summing circuit 60, and outputs the stored signals to the second summing portion 67.

The third summing circuit 70 includes a third register 76 and a third summing portion 77. The third register 76 includes a first flip-flop 71, a second flip-flop 72, a third flip-flop 73, a fourth flip-flop 74 and a fifth flip-flop 75. The third register 76 stores signals applied to the third summing circuit 70, and outputs the stored signals to the third summing portion 77.

Figure 3:
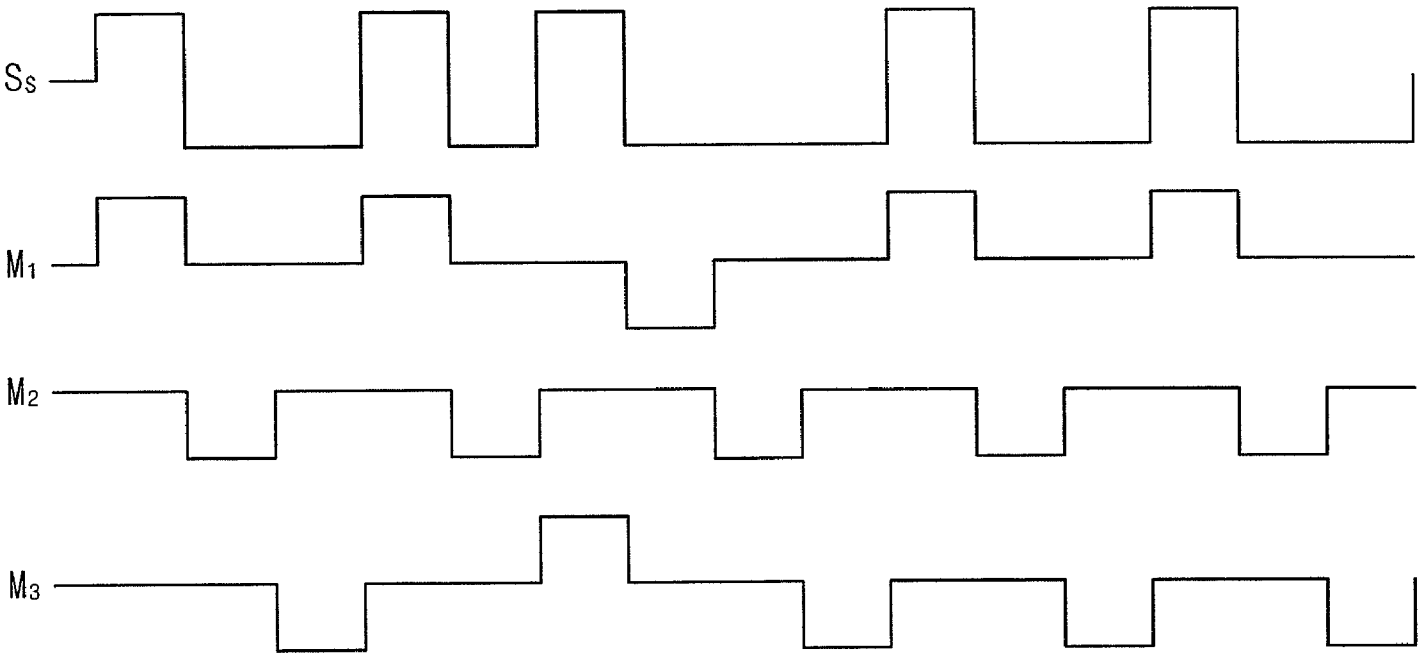
FIG. 3 is a timing diagram illustrating a light-sensing signal, a first distribution signal, a second distribution signal and a third distribution signal of the apparatus for adjusting the luminance shown in FIG. 1.

FIG. 3 is a timing diagram illustrating a light-sensing signal, a first distribution signal, a second distribution signal and a third distribution signal of the apparatus for adjusting the luminance shown in FIG. 1.

In operation, the summing part 80 receives the photo sensing signal $S_S$ during a reference period including a plurality of sensing periods to output a first summation signal SUM1, a second summation signal SUM2 and a third summation signal SUM3. In FIG. 3, the reference period includes fifteen sensing periods. For example, each of the sensing periods may be about 6.7 ms, and the reference period may be about 100 ms. Alternatively, the summing part 80 may include n summing circuits outputting n summation signals, and the reference period may include 3n sensing periods.

For example, the distributing circuit 40 extracts a photo sensing signal $S_S$ applied to the distributing circuit 40 during a first sensing period, and applies a first distribution signal M1 of the first sensing period to the first flip-flop 51 of the first summing circuit 50. Then, the distributing circuit 40 extracts a photo sensing signal $S_S$ applied to the distributing circuit 40 during a second sensing period, and applies a second distribution signal M2 of the second sensing period to the first flip-flop 61 of the second summing circuit 60. Then, the distributing circuit 40 extracts a photo sensing signal $S_S$ applied to the distributing circuit 40 during a third sensing period, and applies a third distribution signal M3 of the third sensing period to the first flip-flop 71 of the third summing circuit 70.

The distributing circuit 40 then extracts sensing signals $S_S$. A sensing signal $S_S$ is applied to the distributing circuit 40 during a fourth sensing period. The sensing signal $S_S$ is applied to the distributing circuit 40 during a fifth sensing period. The sensing signal $S_S$ applied to the distributing circuit 40 during a sixth sensing period. First, second and third distribution signals M1, M2 and M3 are applied to the second flip-flop 52 of the first summing circuit 50, the second flip-flop 62 of the second summing circuit 60 and the second flip-flop 72 of the third summing circuit 70, in sequence.

The distributing circuit 40 then extracts sensing signals $S_S$ applied to the distributing circuit 40 during seventh, eighth and ninth sensing periods to apply first, second and third distribution signals M1, M2 and M3 to the third flip-flops 53, 63 and 73 of the first, second and third summing circuits 50, 60 and 70, in sequence.

The distributing circuit 40 then extracts sensing signals $S_S$ applied to the distributing circuit 40 during tenth, eleventh and twelfth sensing periods to apply first, second and third distribution signals M1, M2 and M3 to the fourth flip-flops 54, 64 and 74 of the first, second and third summing circuits 50, 60 and 70, in sequence.

The distributing circuit 40 then extracts sensing signals $S_S$ applied to the distributing circuit 40 during thirteenth, fourteenth and fifteenth sensing periods to apply first, second and third distribution signals M1, M2 and M3 to the fifth flip-flops 55, 65 and 75 of the first, second and third summing circuits 50, 60 and 70, in sequence.

The first summing portion 57 sums the first distribution signals M1 applied to the first, second, third, fourth and fifth flip-flops 51, 52, 53, 54 and 55 of the first summing circuit 50 to output a first summation signal SUM1. In FIGS. 1 to 3, the first summation signal SUM1 has substantially the same state as a majority of the first distribution signals M1 applied to the first summing circuit 50. For example, when the first distribution signal M1 applied to the first, second, third, fourth and fifth flip-flops 51, 52, 53, 54 and 55 of the first summing circuit 50 are in a high state, a high state, a low state, a high state and a high state, respectively, the first summation signal SUM1 may be in the high state.

The second summing portion 67 sums the second distribution signals M2 applied to the first, second, third, fourth and fifth flip-flops 61, 62, 63, 64 and 65 of the second summing circuit 60 to output a second summation signal SUM2. In FIGS. 1 to 3, the second summation signal SUM2 has substantially the same state as a majority of the second distribution signals M2 applied to the second summing circuit 60.

The third summing portion 77 sums the third distribution signals M3 applied to the first, second, third, fourth and fifth flip-flops 71, 72, 73, 74 and 75 of the third summing circuit 70 to output a third summation signal SUM3. In FIGS. 1 to 3, the third summation signal SUM3 has substantially the same state as a majority of the third distribution signals M3 applied to the third summing circuit 70.

Therefore, the summing part 80 sums variations of luminance during the reference period to output the first, second and third summation signals SUM1, SUM2 and SUM3.

The mode selecting part 110 is electrically connected to the summing part 80, the inverting part 150 and the decoding part 160.

The mode selecting part 110 determines a transflective mode or a transmissive mode based on a mode selection signal SET_DIM. For example, when the display panel is a transflective-type display panel, the mode selection signal SET_DIM may be 0, and the mode selecting part 110 may be in the transflective mode. When the display panel is a transmissive-type display panel, the mode selection signal SET_DIM may be 1, and the mode selecting part 110 may be in the transmissive mode.

When the mode selecting part 110 is in the transflective mode, the first, second and third summation signals SUM1, SUM2 and SUM3 outputted from the first, second and third summing portions 57, 67 and 77 are directly applied to the decoding part 160.

When the mode selecting part 110 is in the transmissive mode, the first, second and third summation signals SUM1, SUM2 and SUM3 outputted from the first, second and third summing portions 57, 67 and 77 are applied to the inverting part 150.

The inverting part 150 includes a first inverter 120, a second inverter 130 and a third inverter 140. The first, second and third inverters 120, 130 and 140 output a first inversion signal, a second inversion signal and a third inversion signal INV1, INV2 and INV3 based on the first, second and third summation signals SUM1, SUM2 and SUM3, respectively. In FIGS. 1 to 3, the first inverter 120 inverts the first summation signal SUM1 to output the first inversion signal INV1. The second inverts the second summation signal SUM2 to output the second inversion signal INV2. The third inverter 140 inverts the third summation signal SUM3 to output the third inversion signal INV3.

The first, second and third inversion signals INV1, INV2 and INV3 have states opposite to the first, second and third summation signals SUM1, SUM2 and SUM3, respectively. For example, when the first, second and third summation signals SUM1, SUM2 and SUM3 are in a high state, a low state and a high state, respectively, the first, second and third inversion signals INV1, INV2 and INV3 may be in a low state, a high state and a low state, respectively.

When the mode selection part 110 is in the transmissive mode, the decoding part 160 receives the first, second and third inversion signals INV1, INV2 and INV3 to output a first decoding signal OUT1 and a second decoding signal OUT2 to a driving IC 180 through a first output terminal 162 and a second output terminal 164, respectively. In addition, when the mode selection part 110 is in the transflective mode, the decoding part 160 receives the first, second and third summation signals SUM1, SUM2 and SUM3 to output a first decoding signal OUT1 and a second decoding signal OUT2 to the driving IC 180 through the first output terminal 162 and the second output terminal 164, respectively.

When a number of the low states of the signals are applied to the decoding part 160, the first and second decoding signals OUT1 and OUT2 outputted from the decoding part 160 correspond to a low luminance. When a number of the high states of the signals are applied to the decoding part 160, the first and second decoding signals OUT1 and OUT2 outputted from the decoding part 160 correspond to a high luminance.

The driving IC 180 outputs a driving current $I_D$ based on the first and second decoding signals OUT1 and OUT2 of the decoding part 160.

In FIGS. 1 to 3, when the first and second decoding signals OUT1 and OUT2 outputted through the first and second output terminals 162 and 164 are 1, the driving current $I_D$ has a first level.

Also, when the first and second decoding signals OUT1 and OUT2 outputted through the first and second output terminals 162 and 164 are 1 and 0, respectively, the driving current $I_D$ has a second level.

In addition, when the first and second decoding signals OUT1 and OUT2 outputted through the first and second output terminals 162 and 164 are 0 and 1, respectively, the driving current $I_D$ has a third level.

Furthermore, when the first and second decoding signals OUT1 and OUT2 outputted through the first and second output terminals 162 and 164 are 0, the driving current $I_D$ has a fourth level.

Table 1 represents a relationship between levels of the mode selection signal SET_DIM, the first, second and third summation signals SUM1, SUM2 and SUM3, the first, second and third inversion signals INV1, INV2 and INV3 and the first and second decoding signals OUT1 and OUT2 outputted through the first and second output terminals 162 and 164, the driving current $I_D$ and luminance of a light source of the display panel of the transmissive mode, which has the apparatus 100 for adjusting the luminance.

Referring to Table 1, the first, second, third and fourth levels of the driving currents $I_D$ are about 0.4 mA, about 1.25 mA, about 4.15 mA and about 18.65 mA, respectively. Luminances of the light source corresponding to the first, second, third and fourth levels are about 7 nits, about 25 nits, about 75 nits and about 250 nits, respectively.

When an external luminance level applied to the display panel are relatively low, the first, second and third summation signals SUM1, SUM2 and SUM3 are in the low states, and the first, second and third inversion signals INV1, INV2 and INV3 are in the high states. Thus, both of the first and second decoding signals OUT1 and OUT2 outputted through the first and second output terminals 162 and 164 are 0 so that the driving current $I_D$ has a first level of about 0.4 mA. Therefore, the luminance of the light source is about 7 nits.

When the external luminance level applied to the display panel are relatively low, one of the first, second and third summation signals SUM1, SUM2 and SUM3 are in the high state, and one of the first, second and third inversion signals INV1, INV2 and INV3 are in the low state. Thus, the first and second decoding signals OUT1 and OUT2 outputted through the first and second output terminals 162 and 164 are 0 and 1, respectively, and the driving current $I_D$ has the first level of about 1.25 mA. Therefore, the luminance of the light source is about 25 nits.

When the external luminance level applied to the display panel is relatively high, two of the first, second and third summation signals SUM1, SUM2 and SUM3 are in the high states, and two of the first, second and third inversion signals INV1, INV2 and INV3 are in the low states. Thus, the first and second decoding signals OUT1 and OUT2 outputted through the first and second output terminals 162 and 164 are 1 and 0, respectively, so that the driving current $I_D$ has the first level of about 4.15 mA. Therefore, the luminance of the light source is about 75 nits.

When the external luminance level applied to the display panel is relatively high, the first, second and third summation signals SUM1, SUM2 and SUM3 are in the high states, and the first, second and third inversion signals INV1, INV2 and INV3 are in low states. Thus, both of the first and second decoding signals OUT1 and OUT2 outputted through the first and second output terminals 162 and 164 are 1, so that the driving current $I_D$ has the first level of about 18.65 mA. Therefore, the luminance of the light source is about 250 nits.

Therefore, when the external luminance level is decreased, the level of the driving current $I_D$ of the transmissive mode is decreased so that the luminance of the light source is decreased. Thus, the display panel displayed an image using the light generated from the light source, which has the low luminance. In addition, when the external luminance level is increased, the level of the driving current $I_D$ of the transmissive mode is increased so that the luminance of the light source was increased. Thus, the display panel displayed an image using the light generated from the light source, which has the high luminance.

TABLE 1

| SET_DIM = 1 | | | | | | | | | |
|---|---|---|---|---|---|---|---|---|---|
| SUM1 | SUM2 | SUM3 | INV1 | INV2 | INV3 | OUT1 | OUT2 | $I_D$ (mA) | LUMINANCE (nit) |
| L | L | L | H | H | H | 0 | 0 | 0.4 | 7 |
| L | L | H | H | H | L | 0 | 1 | 1.25 | 25 |
| L | H | H | H | L | L | 1 | 0 | 4.15 | 75 |
| H | H | H | L | L | L | 1 | 1 | 18.65 | 250 |

Table 2 represents a relationship between levels of the mode selection signal SET_DIM, the first, second and third summation signals SUM1, SUM2 and SUM3, the first, second and third inversion signals INV1, INV2 and INV3 and the first and second decoding signals OUT1 and OUT2 outputted through the first and second output terminals 162 and 164, the driving current $I_D$ and luminance of a light source of the display panel of the transflective mode, which has the apparatus 100 for adjusting the luminance.

TABLE 2

| SET_DIM = 0 | | | | | | |
|---|---|---|---|---|---|---|
| SUM1 | SUM2 | SUM3 | OUT1 | OUT2 | $I_D$ (mA) | LUMINANCE (nit) |
| H | H | H | 0 | 0 | 0.4 | 7 |
| L | H | H | 0 | 1 | 1.25 | 25 |
| L | L | H | 1 | 0 | 4.15 | 75 |
| L | L | L | 1 | 1 | 18.65 | 250 |

Referring to Table 2, when the external luminance level applied to the display panel is relatively high, the first, second and third summation signals SUM1, SUM2 and SUM3 are in the high states. Thus, both of the first and second decoding signals OUT1 and OUT2 outputted through the first and second output terminals 162 and 164 are 0, so that the driving current $I_D$ has the first level of about 0.4 mA. Therefore, the luminance of the light source is about 7 nits.

When the external luminance level applied to the display panel is relatively high, two of the first, second and third summation signals SUM1, SUM2 and SUM3 are in the high states. Thus, the first and second decoding signals OUT1 and OUT2 outputted through the first and second output terminals 162 and 164 are 0 and 1, respectively, so that the driving current $I_D$ has the first level of about 1.25 mA. Therefore, the luminance of the light source is about 25 nits.

When the external luminance level applied to the display panel is relatively low, one of the first, second and third summation signals SUM1, SUM2 and SUM3 is in the high state. Thus, the first and second decoding signals OUT1 and OUT2 outputted through the first and second output terminals 162 and 164 are 1 and 0, respectively, so that the driving current $I_D$ has the first level of about 4.15 mA. Therefore, the luminance of the light source is about 75 nits.

When an external luminance level applied to the display panel is very low, each of the first, second and third summation signals SUM1, SUM2 and SUM3 are in the low states. Thus, both of the first and second decoding signals OUT1 and OUT2 outputted through the first and second output terminals 162 and 164 are 1 so that the driving current $I_D$ has the first level of about 18.65 mA. Therefore, the luminance of the light source is about 250 nits.

Therefore, when the external luminance level is decreased, the level of the driving current $I_D$ of the transflective mode is increased so that the luminance of the light source is increased. Thus, the display panel displayed an image using the light generated from the light source, which has the high luminance. In addition, when the external luminance level is increased, the level of the driving current $I_D$ of the transflective mode is decreased so that the luminance of the light source is decreased. Thus, the display panel displayed an image using the light generated from the light source, which has the low luminance.

According to the apparatus for adjusting the luminance shown in FIGS. 1 to 3, the apparatus 100 for adjusting the luminance includes the mode selecting part 110 to be commonly used for both the transflective display panel and the transmissive display panel.

When the transmissive display panel includes the apparatus 100 for adjusting the luminance, the luminance of the light source may be increased as the external luminance is decreased. Thus, light pollution may be decreased in a dark place, and power consumption may be decreased.

In addition, the transflective display panel includes the apparatus 100 for adjusting the luminance, the luminance of the light source may be decreased as the external luminance is increased. Thus, the transflective display panel may display the image using the external light and the light generated from the light source.

Figure 4:
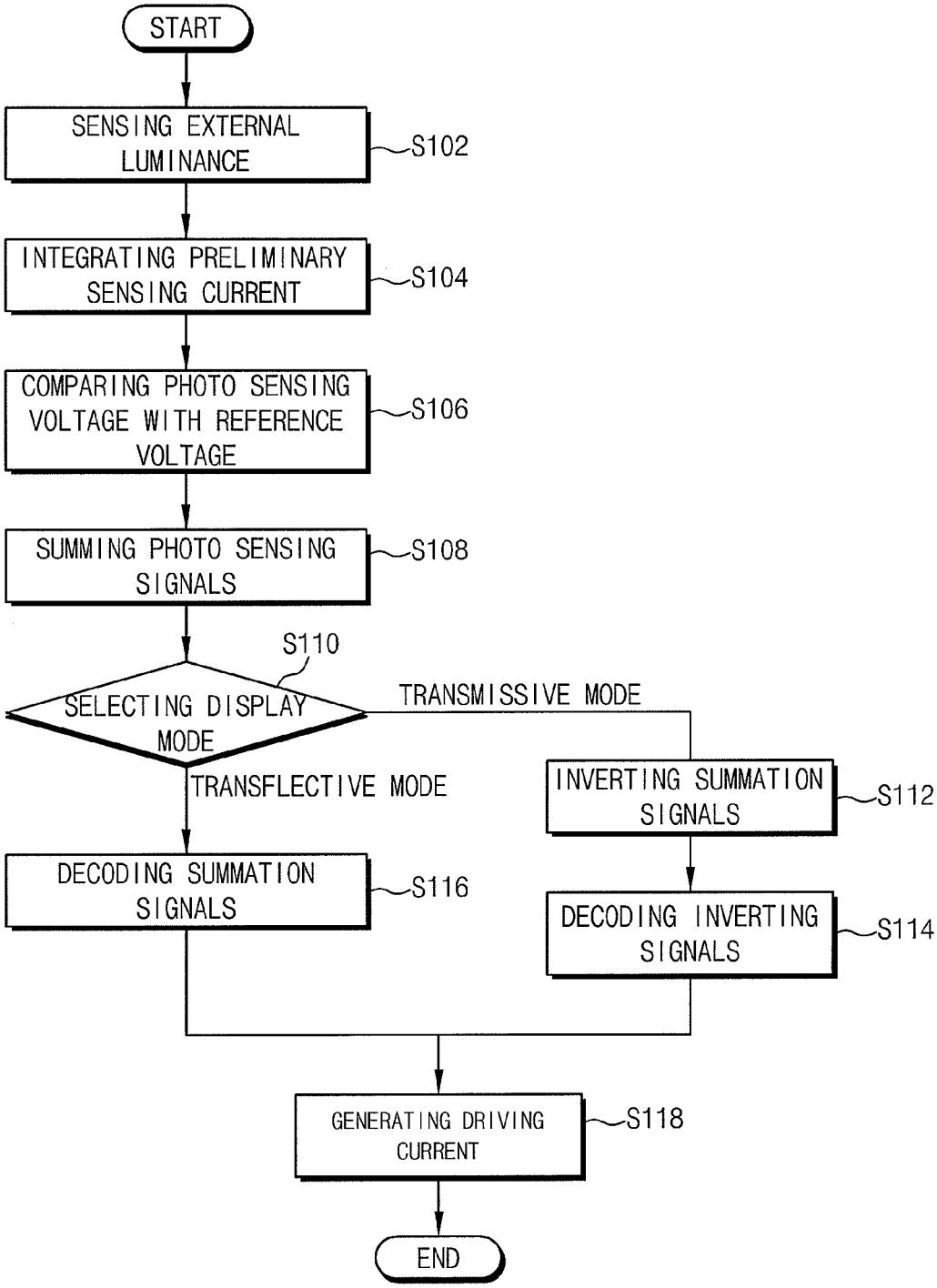
FIG. 4 is a flow chart illustrating a method of adjusting luminance using the apparatus shown in FIG. 1.

FIG. 4 is a flow chart illustrating a method of adjusting luminance using the apparatus shown in FIG. 1.

Referring to FIGS. 2 and 4, in adjusting the luminance of the light source, the preliminary sensing signal $I_0$ is generated based on the external luminance level applied to the display device (step S102). In FIGS. 2 and 4, the photo sensors 12 are formed on the array substrate of the display panel to sense the external luminance level.

The preliminary sensing current $I_0$ is integrated by the unit sensing period to generate the photo sensing voltages $V_P$ corresponding to the sensing periods, respectively (step S104). For example, each of the sensing periods may be about 6.7 ms.

Each of the photo sensing voltages $V_P$ is compared with the reference voltage $V_R$ in each sensing period to generate the photo sensing signal $S_S$ (step S106). In FIGS. 2 and 4, when the photo sensing voltage $V_P$ has a lower level than the reference voltage $V_R$, the comparing part 30 generates the photo sensing signal $S_S$ of the low state. When the photo sensing voltage $V_P$ has a higher level than the reference voltage $V_R$, the comparing part 30 generates the photo sensing signal $S_S$ of the high state.

The photo sensing signals $S_S$ of the sensing periods are summed to generate the first, second and third summation signals SUM1, SUM2 and SUM3 (step S108). When summing the photo sensing signals $S_S$, the photo sensing signals $S_S$ are distributed to the first, second and third summing circuits 50, 60 and 70 in each sensing period to generate the first, second and third distribution signals M1, M2 and M3. The first, second and third distribution signals M1, M2 and M3 are respectively summed to generate the first, second and third summation signals SUM1, SUM2 and SUM3.

The transmissive mode or the transflective mode is selected based on a panel type of the display panel including the apparatus 100 for adjusting the luminance (step S110). In FIGS. 2 and 4, the mode selecting part 110 adjusts the output of the first, second and third summation signals SUM1, SUM2 and SUM3 based on the mode selection signal SET_DIM. The mode selection signal SET_DIM may be previously determined.

When the display panel is the transmissive mode, the first, second and third summation signals SUM1, SUM2 and SUM3 are inverted to generate the first, second and third inversion signals INV1, INV2 and INV3 (step S112). The first, second and third inversion signals INV1, INV2 and INV3 are decoded (step S114).

In FIGS. 2 and 4, the decoding part 160 decodes the first, second and third inversion signals INV1, INV2 and INV3 to generate the first and second decoding signals OUT1 and OUT2 that form a binary number of double digit.

The number of the inversion signals may be substantially the same as the number of the summation signals. When the number of the inversion signals is about 2m−1, the number of the decoding signals which corresponds to the digit of the binary number formed by the decoding signals is m, wherein m is a natural number.

In addition, when the number of the inversion signals is about m, the number of the decoding signals which corresponds to the digit of the binary number formed by the decoding signals is m+1.

When the display panel is the transflective mode, the first, second and third summation signals SUM1, SUM2 and SUM3 are directly decoded to generate the first and second decoding signals OUT1 and OUT2 (step S116).

The driving current having the level corresponding to the first and second decoding signals OUT1 and OUT2 is generated (step S118). The driving current is applied to the light source.

Therefore, the external luminance level is sensed during the sensing periods, and the sensing signals corresponding to the external luminance level are summed. The summed sensing signals are decoded to change the luminance of the light by the reference period based on the change of the external luminance level.

Figure 5:
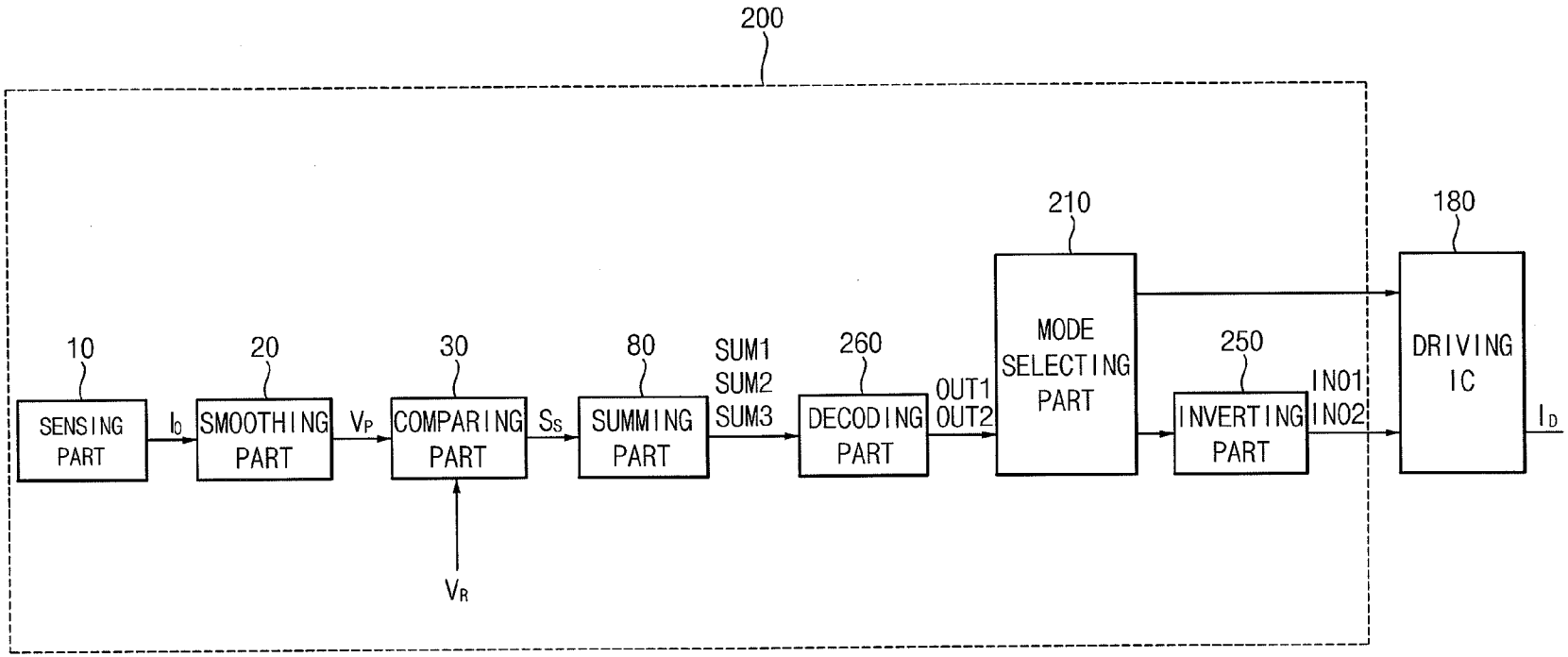
FIG. 5 is a block diagram illustrating an apparatus for adjusting luminance in accordance with an exemplary embodiment of the present invention.
Figure 6:
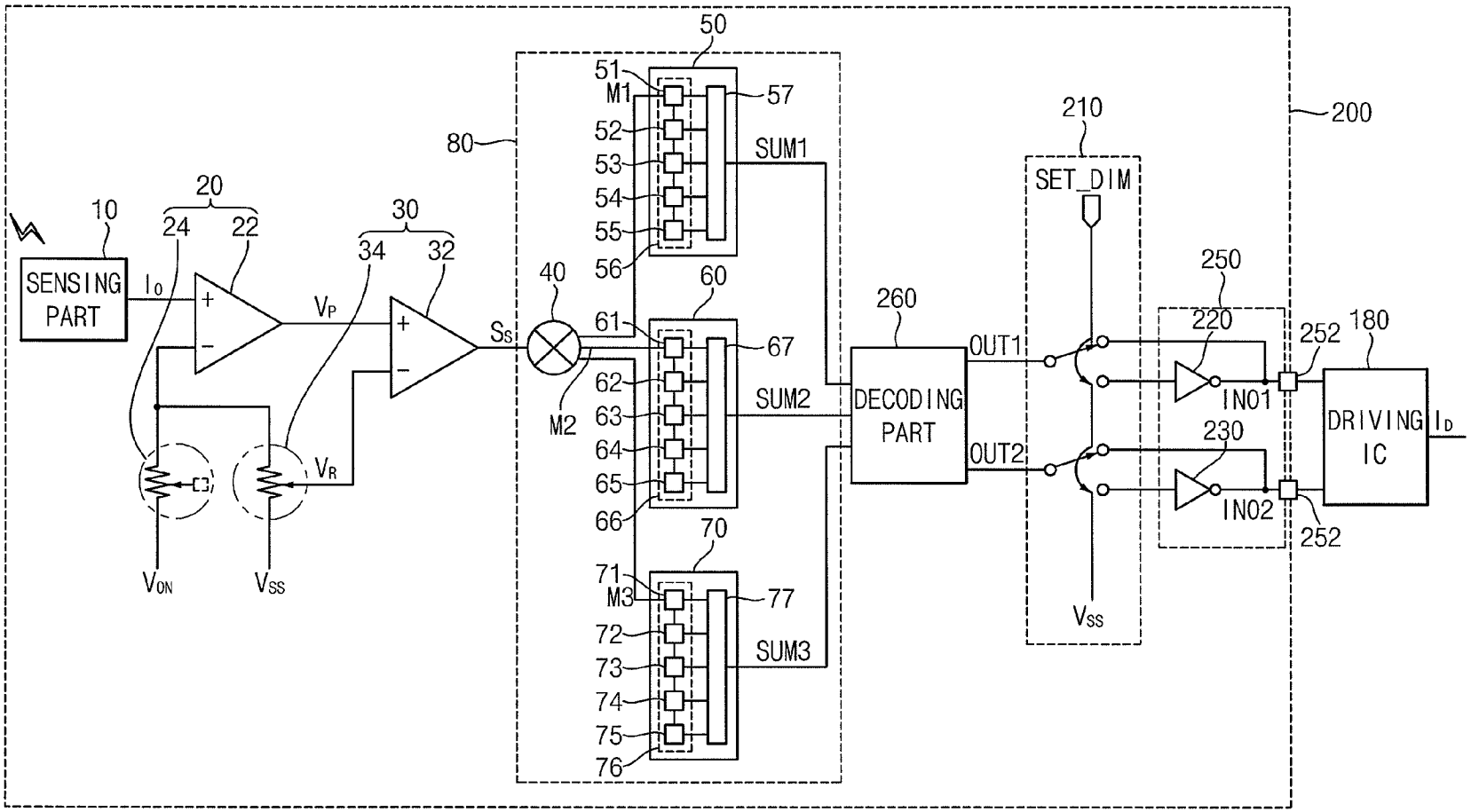
FIG. 6 is a circuit diagram illustrating the apparatus for adjusting the luminance shown in FIG. 5.

FIG. 5 is a block diagram illustrating an apparatus for adjusting luminance in accordance with a second exemplary embodiment of the present invention. FIG. 6 is a circuit diagram illustrating the apparatus for adjusting the luminance shown in FIG. 5. The apparatus for adjusting the luminance of FIGS. 5 and 6 is substantially the same as in FIGS. 1 and 2 except for a decoding part, a mode selecting part and an inverting part. Thus, the same reference numerals will be used to refer to the same or like parts as those described in FIGS. 1 and 2 and any further explanation concerning the above elements will be omitted.

Referring to FIGS. 5 and 6, the apparatus 200 for adjusting the luminance includes a sensing part 10, a smoothing part 20, a comparing part 30, a summing part 80, a decoding part 260, a mode selecting part 210 and a comparing part 250. The apparatus 200 for adjusting the luminance is electrically connected to a driving IC 180. In FIGS. 5 and 6, the summing part and the decoding part 260 form a summing unit assembly.

The decoding part 260 decodes first, second and third summation signals SUM1, SUM2 and SUM3 that are outputted from the summing part 80 to generate first and second decoding signals OUT1 and OUT2.

In FIGS. 5 and 6, when the first, second and third summation signals SUM1, SUM2 and SUM3 have low states, both of the first and second decoding signals OUT1 and OUT2 are 1.

In addition, when two of the first, second and third summation signals SUM1, SUM2 and SUM3 have low states, the first and second decoding signals OUT1 and OUT2 are 1 and 0, respectively.

When one of the first, second and third summation signals SUM1, SUM2 and SUM3 have the low state, the first and second decoding signals OUT1 and OUT2 are 0 and 1, respectively.

When the first, second and third summation signals SUM1, SUM2 and SUM3 have the high states, both of the first and second decoding signals OUT1 and OUT2 are 0.

The mode selecting part 210 is electrically connected to the decoding part 260 and the inverting part 250.

The mode selecting part 210 determines a transflective mode or a transmissive mode based on a mode selection signal SET_DIM. For example, when the display panel is a transflective-type display panel, the mode selection signal SET_DIM may be 0, and the mode selecting part 210 may be in the transflective mode. When the display panel is a transmissive-type display panel, the mode selection signal SET_DIM may be 1, and the mode selecting part 210 may be in the transmissive mode.

When the mode selecting part 210 is in the transflective mode, the first and second decoding signals OUT1 and OUT2 outputted from the decoding part 260 are directly applied to first and second output terminals 252 and 254, respectively.

When the mode selecting part 210 is in the transmissive mode, the first and second decoding signals OUT1 and OUT2 outputted from the decoding part 260 are applied to the inverting part 250.

The inverting part 250 includes a first inverter 220 and a second inverter 230. When the mode selecting part 210 is in the transmissive mode, the inverting part 250 receives the first and second decoding signals OUT1 and OUT2 to output first and second inversion signals INO1 and INO2 to the first and second output terminals 252 and 254, respectively. In FIGS. 5 and 6, the first inverter 220 inverts the first decoding signal OUT1 to output the first inversion signal INO1, and the second inverter 230 inverts the second decoding signal OUT2 to output the second inversion signal INO2.

The first and second inversion signals INO1 and INO2 have states opposite to the first and second decoding signals OUT1 and OUT2, respectively. For example, when the first and second decoding signals OUT1 and OUT2 are 1 and 0, respectively, the first and second inversion signals INO1 and INO2 may be 0 and 1, respectively.

The driving IC 180 outputs a driving current $I_D$ based on the first and second decoding signals OUT1 and OUT2 or the first and second inversion signals INO1 and INO2 that are applied to the first and second output terminals 252 and 254 of the inverting part 250.

Table 3 represents a relationship between levels of the mode selection signal SET_DIM, the first, second and third summation signals SUM1, SUM2 and SUM3, the first and second decoding signals OUT1 and OUT2, the first and second inversion signals INO1 and INO2, the driving current $I_D$ and luminance of a light source of the display panel of the transmissive mode, which has the apparatus 200 for adjusting the luminance.

TABLE 3

| SET_DIM = 1 | | | | | | | | |
|---|---|---|---|---|---|---|---|---|
| SUM1 | SUM2 | SUM3 | OUT1 | OUT2 | INO1 | INO2 | $I_D$ (mA) | LUMINANCE (nit) |
| L | L | L | 1 | 1 | 0 | 0 | 0.4 | 7 |
| L | L | H | 1 | 0 | 0 | 1 | 1.25 | 25 |
| L | H | H | 0 | 1 | 1 | 0 | 4.15 | 75 |
| H | H | H | 0 | 0 | 1 | 1 | 18.65 | 250 |

Referring to Table 3, when an external luminance level applied to the display panel is very low, the first, second and third summation signals SUM1, SUM2 and SUM3 are in the low states. Both of the first and second decoding signals OUT1 and OUT2 are 1, and both of the first and second inversion signals INO1 and INO2 are 0. Thus, the driving current $I_D$ has the first level of about 0.4 mA, and the luminance of the light source is about 7 nits.

When the external luminance level applied to the display panel is relatively low, one of the first, second and third summation signals SUM1, SUM2 and SUM3 is in the high state. The first and second decoding signals OUT1 and OUT2 are 1 and 0, respectively, and the first and second inversion signals INO1 and INO2 are 0 and 1, respectively. Thus, the driving current $I_D$ has the first level of about 1.25 mA, and the luminance of the light source is about 25 nits.

When the external luminance level applied to the display panel is relatively high, two of the first, second and third summation signals SUM1, SUM2 and SUM3 are in the high states. The first and second decoding signals OUT1 and OUT2 are 0 and 1, respectively, and the first and second inversion signals INO1 and INO2 are 1 and 0, respectively. Thus, the driving current $I_D$ has the first level of about 4.15 mA, and the luminance of the light source is about 75 nits.

When the external luminance level applied to the display panel is very high, the first, second and third summation signals SUM1, SUM2 and SUM3 are in the high states. Both of the first and second decoding signals OUT1 and OUT2 is 0, and both of the first and second inversion signals INO1 and INO2 is 1. Thus, the driving current $I_D$ has the first level of about 18.65 mA, and the luminance of the light source is about 250 nits.

Therefore, when the external luminance level is decreased, the level of the driving current $I_D$ of the transmissive mode is decreased so that the luminance of the light source is decreased. Thus, the display panel displayed an image using the light generated from the light source, which has the low luminance. In addition, when the external luminance level is increased, the level of the driving current $I_D$ of the transmissive mode is increased so that the luminance of the light source is increased. Thus, the display panel displayed an image using the light generated from the light source, which has the high luminance.

Table 4 represents a relationship between levels of the mode selection signal SET_DIM, the first, second and third summation signals SUM1, SUM2 and SUM3, the first and second decoding signals OUT1 and OUT2, the first and second inversion signals INO1 and INO2, the driving current $I_D$ and luminance of a light source of the display panel of the transflective mode, which has the apparatus 200 for adjusting the luminance. In the transflective mode, the first and second decoding signals OUT1 and OUT2 are applied to the first and second output terminals 252 and 254 of the inverting part 250, respectively.

TABLE 4

| SET_DIM = 0 | | | | | | |
|---|---|---|---|---|---|---|
| SUM1 | SUM2 | SUM3 | OUT1 | OUT2 | $I_D$ (mA) | LUMINANCE (nit) |
| H | H | H | 0 | 0 | 0.4 | 7 |
| L | H | H | 0 | 1 | 1.25 | 25 |
| L | L | H | 1 | 0 | 4.15 | 75 |
| L | L | L | 1 | 1 | 18.65 | 250 |

In Table 4, the levels of the first, second and third summation signals SUM1, SUM2 and SUM3, the first and second decoding signals OUT1 and OUT2, the driving current ID and the luminance are substantially the same as in Table 2. Thus, any further explanation concerning the above elements will be omitted.

According to the apparatus for adjusting the luminance shown in FIGS. 5 and 6, the number of switching elements of the mode selecting part 210 and the number of the inverters 220 and 230 of the inverting part 250 may be decreased to decrease defects, and manufacturing costs of the apparatus 200 for adjusting the luminance may be decreased.

Figure 7:
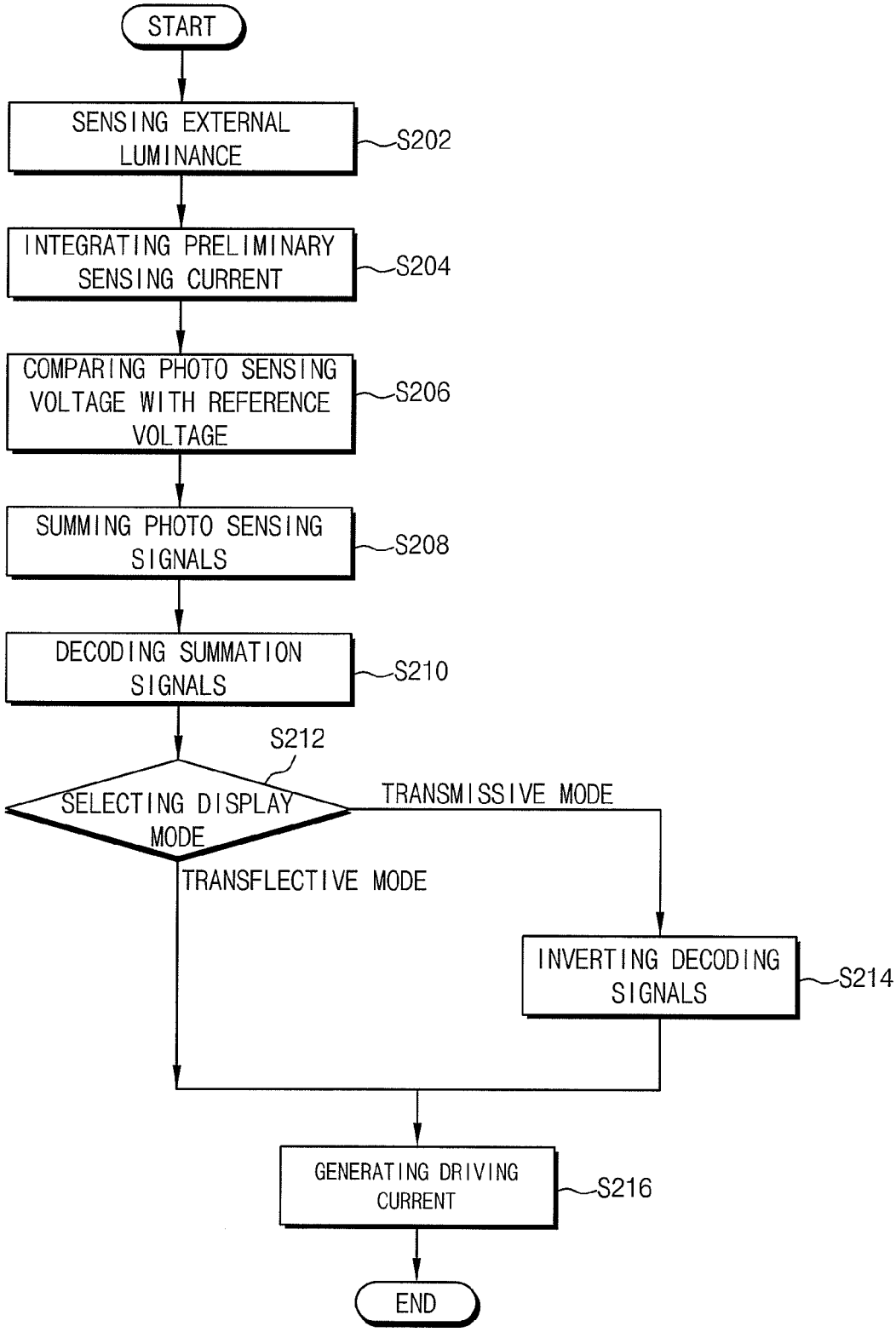
FIG. 7 is a flow chart illustrating a method of adjusting luminance using the apparatus shown in FIG. 5.

FIG. 7 is a flow chart illustrating a method of adjusting luminance using the apparatus shown in FIG. 5.

Referring to FIGS. 6 and 7, in order to adjust the luminance of the light source, the preliminary sensing signal $I_0$ is generated based on the external luminance level to the display device (step S202).

The preliminary sensing current $I_0$ is integrated by the unit sensing period to generate the photo sensing voltages $V_P$ corresponding to the sensing periods, respectively (step S204).

Each of the photo sensing voltages $V_P$ is compared with the reference voltage $V_R$ in each sensing period to generate the photo sensing signal $S_S$ (step S206).

The photo sensing signals $S_S$ of the sensing periods are summed to generate the first, second and third summation signals SUM1, SUM2 and SUM3 (step S208).

The first, second and third summation signals SUM1, SUM2 and SUM3 are decoded to generate the first and second decoding signals OUT1 and OUT2 (step S210).

The transmissive mode or the transflective mode is selected based on a panel type of the display panel including the apparatus 100 for adjusting the luminance (step S212).

When the display panel is in the transmissive mode, the first and second decoding signals OUT1 and OUT2 are inverted to form the first and second inversion signals INO1 and INO2 (step S214).

The driving current having the level corresponding to the first and second inversion signals INO1 and INO2 or the first and second decoding signals OUT1 and OUT2 is generated (step S216). When the display panel is in the transmissive mode, the driving current has the level corresponding to the first and second inversion signals INO1 and INO2. When the display panel is in the transflective mode, the driving current has the level corresponding to the first and second decoding signals OUT1 and OUT2.

The driving current is applied to the light source.

According to the method of adjusting the luminance of FIG. 7, the method of adjusting the luminance may be simplified.

Figure 8:
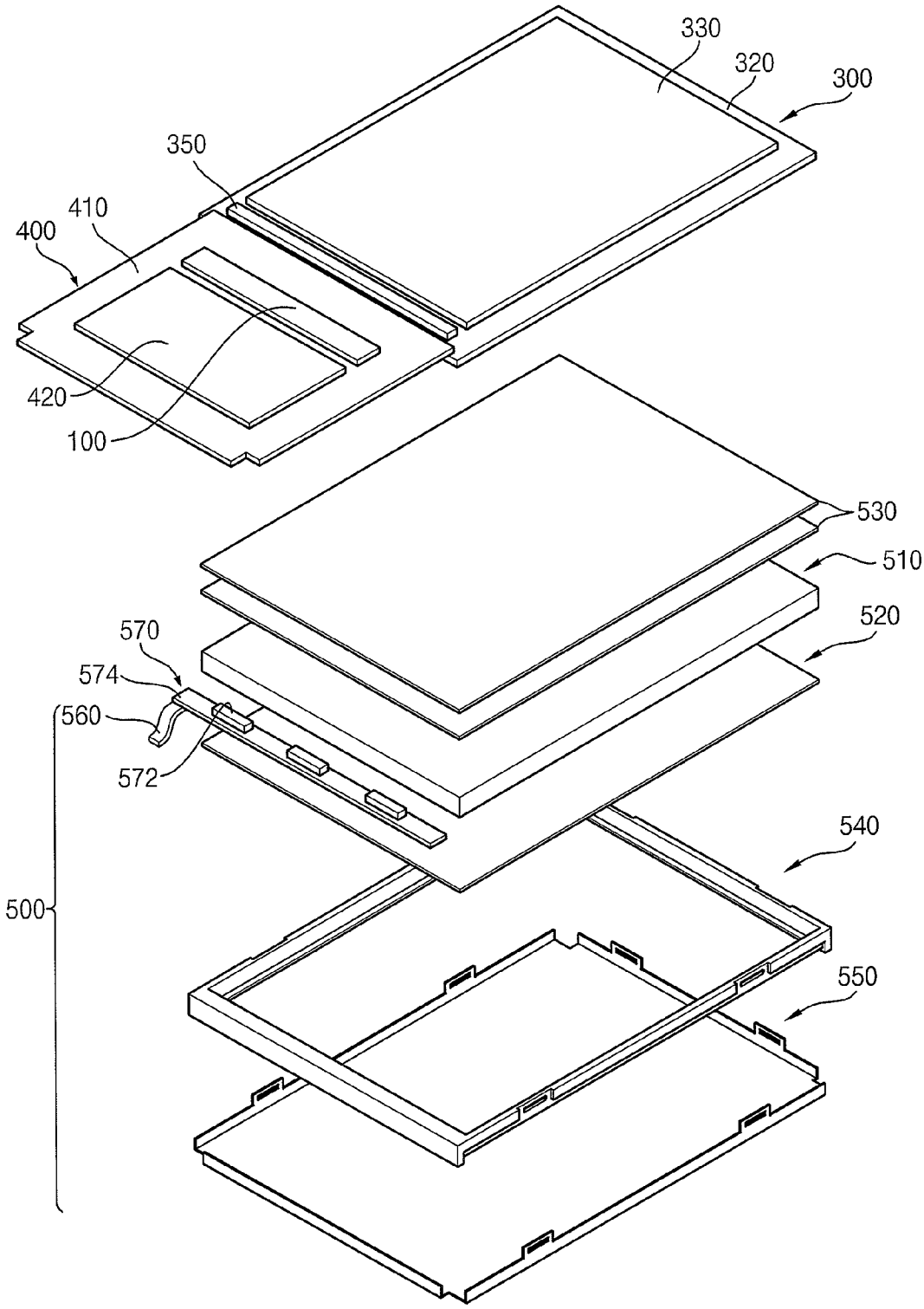
FIG. 8 is an exploded perspective view illustrating a display device in accordance with an exemplary embodiment of the present invention.

FIG. 8 is an exploded perspective view illustrating a display device in accordance with a third exemplary embodiment of the present invention.

Referring to FIGS. 2 and 8, the display device includes a display panel 300, an IC board 400 and a backlight assembly 500.

The display panel 300 includes an array substrate 320, an opposite substrate 330, a liquid crystal layer (not shown) and a panel driving circuit 350.

The array substrate 320 includes a plurality of thin-film transistors (TFT), a plurality of pixel electrodes, a plurality of data lines and a plurality of gate lines. The TFTs are arranged in a matrix shape. The pixel electrodes are electrically connected to the TFTs, respectively. The data and gate lines transmit image signals to the TFTs. A sensing part 10 generating a preliminary sensing current $I_0$ based on an external luminance level may be formed on the array substrate 320. In FIGS. 2 and 8, the sensing part 10 includes four photo transistors (not shown) arranged on four corners of the array substrate 320. Alternatively, the sensing part 10 may further include a photo transistor (not shown) on a center of the array substrate 320.

The opposite substrate 330 faces the array substrate 320, and includes a plurality of color filters (not shown) and a common electrode (not shown). The color filters correspond to the pixel electrodes, respectively. The common electrode faces the pixel electrodes.

The liquid crystal layer is interposed between the array substrate 320 and the opposite substrate 330, and the light transmittance of the liquid crystal layer is changed based on an electric field applied thereto, thereby displaying an image.

In FIGS. 2 and 8, the display panel 300 includes a liquid crystal display (LCD) panel. Alternatively, the display panel 300 may include an electrophoretic display device.

The panel driving circuit 350 is disposed in a peripheral region of the array substrate 320. The panel driving circuit 350 receives a plurality of panel driving signals from the IC board 400 to apply data and gate voltages to the data and gate lines, respectively.

The IC board 400 is electrically connected to an end portion of the array substrate 320. In FIGS. 2 and 8, the IC board 400 includes a flexible base substrate 410, an IC part 420 and an apparatus for adjusting luminance 100.

The flexible base substrate 410 is bent toward a rear surface of the backlight assembly 500.

The IC part 420 generates the panel driving signals based on externally provided image signals.

The apparatus 100 for adjusting the luminance of FIG. 8 is substantially the same as in FIGS. 1 to 7. Thus, any further explanation concerning the above elements will be omitted.

The backlight assembly 500 is disposed under the display panel 300 to supply the display panel 300 with light.

The backlight assembly 500 includes a light-guiding plate 510, a diffusion sheet 520, an optical sheet 530, a mold frame 540, a receiving container 550, a transmitting member 560 and an optical unit 570.

The light-guiding plate 510 is adjacent to the light source unit 570. The light-guiding plate 510 changes the light generated from the light source unit 570 into a planar light to guide the planar light toward the display panel 300.

The reflective sheet 520 is disposed under the light-guiding plate 510 to reflect the light leaked from the light-guiding plate 510 toward the light-guiding plate 510.

The optical sheet 530 is disposed on the light-guiding plate 510 to improve optical characteristics of the light emitted through a light-exiting surface of the light-guiding plate 510. For example, the diffusion sheet 530 may include a diffusion sheet and a prism sheet. The diffusion sheet increases luminance uniformity of the light. The prism sheet increases luminance of the light in a front direction.

The mold frame 540 is disposed under the reflective sheet 520 to support the light-guiding plate 510, the reflective sheet 520, the optical sheet 530 and the light source unit 570.

The receiving container 550 is disposed under the mold frame 540 to receive the light-guiding plate 510, the diffusion sheet 520, the optical sheet 530, the light source unit 570 and the mold frame 540.

The light source unit 570 includes a light source printed circuit board (PCB) 574 and a light-emitting element 572.

The light-emitting element 572 is disposed on the light source PCB 574 to generate the light based on a driving current $I_D$ generated from the apparatus 100 for adjusting the luminance.

The driving current ID is applied to the light-emitting element 572 through the transmitting member 560 and the light source PCB 574. In FIGS. 2 and 8, the light-emitting element 572 includes a light-emitting diode (LED) adjacent to a side of the light-guiding plate 510.

In FIG. 8, the backlight assembly 500 is an edge illumination type backlight assembly. Alternatively, the backlight assembly 500 may be a direct illumination type backlight assembly.

In FIGS. 2 and 8, the apparatus 100 for adjusting the luminance is disposed on the flexible base substrate 410. Alternatively, the apparatus 100 for adjusting the luminance may be disposed on the light-emitting PCB 574.

According to the display device shown in FIG. 8, the IC board 400 includes the apparatus 100 for adjusting the luminance so that the power consumption of the display device may be decreased.

Figure 9:
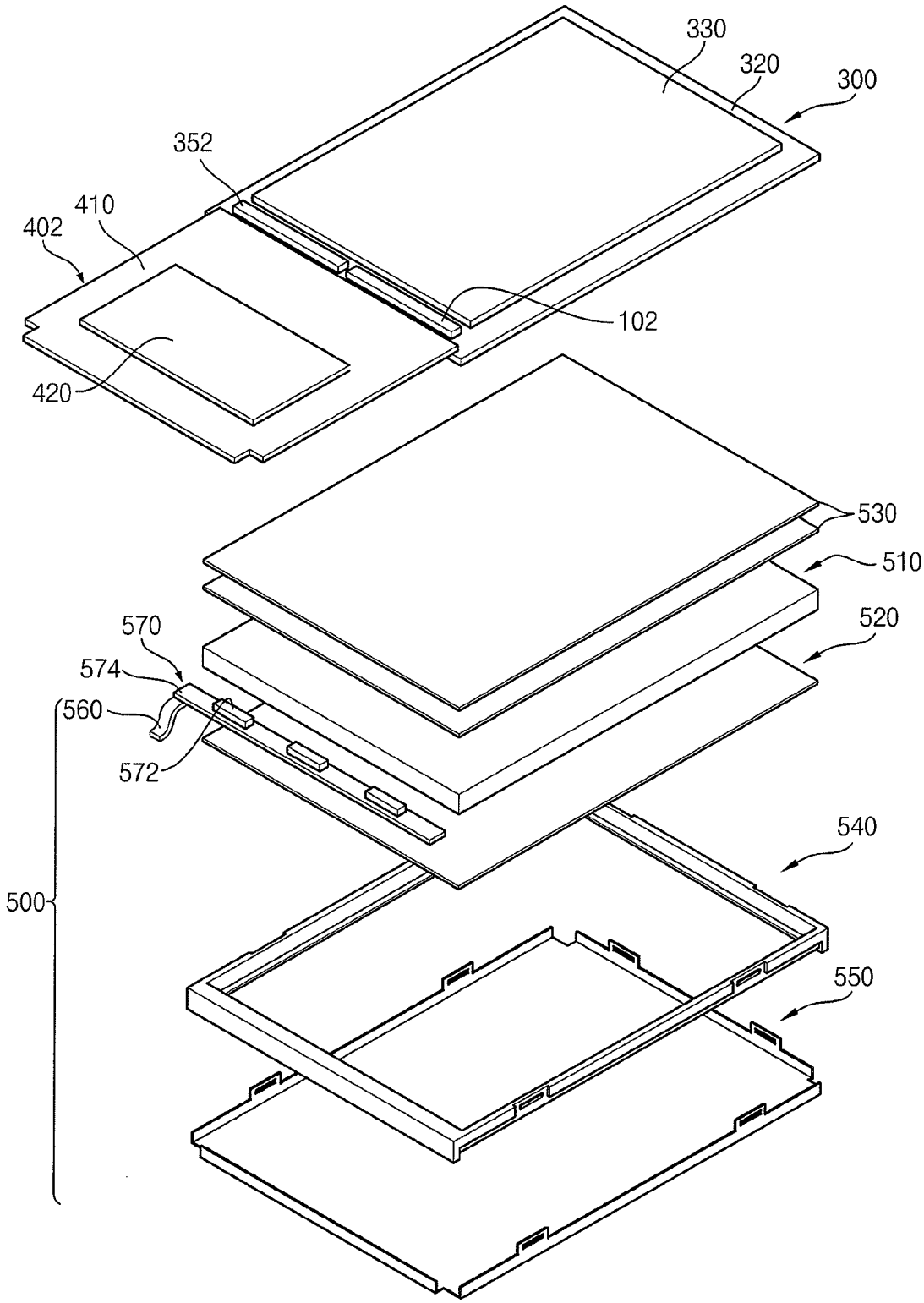
FIG. 9 is an exploded perspective view illustrating a display device in accordance with an exemplary embodiment of the present invention.

FIG. 9 is an exploded perspective view illustrating a display device in accordance with a fourth exemplary embodiment of the present invention. The apparatus for adjusting the luminance of FIG. 9 is substantially the same as in FIG. 8 except for a luminance adjusting unit. Thus, the same reference numerals will be used to refer to the same or like parts as those described in FIG. 8 and any further explanation concerning the above elements will be omitted.

Referring to FIG. 9, the luminance adjusting unit 102 is directly formed on an array substrate 320. For example, the luminance adjusting unit 102 may be formed from substantially the same layer as a panel driving circuit 352. For example, the luminance adjusting unit 102 and the panel driving circuit 352 may be adjacent to a side of the array substrate 320.

The luminance adjusting unit 102 applies a driving voltage having various levels to a light-emitting element 572 of a light source unit 570 through an IC board 402 and a transmitting member 560.

According to the display device of FIG. 9, the luminance adjusting unit 102 is directly formed on the array substrate 320 so that a manufacturing process may be simplified and manufacturing costs may be decreased.

According to an exemplary embodiment of the present invention, an apparatus for adjusting luminance includes a mode selecting part to be commonly used in a transflective-type display panel and a transmissive-type display panel.

In addition, when the apparatus for adjusting the luminance is used for the transmissive-type display panel, the luminance of light may be decreased as external luminance is decreased. Thus, light pollution may be decreased in a dark place, and power consumption may be decreased.

Furthermore, the mode selecting part and an inverting part may have simple structures, so that defects and the manufacturing costs of the apparatus for adjusting the luminance may be decreased.

This invention has been described with reference to the example embodiments. It is evident, however, that many alternative modifications and variations will be apparent to those having skill in the art in light of the foregoing description. Accordingly, the present invention embraces all such alternative modifications and variations as falling within the spirit and scope of the appended claims.

What is claimed is:

1. An apparatus for adjusting luminance, comprising:

a comparing part that compares a photo sensing voltage with a reference voltage in each of a plurality of sensing periods and generates a photo sensing signal;

a summing part that sums the photo sensing signal during the sensing periods and generates a plurality of summation signals;

a mode selecting part controls an application of the summation signals based on a mode selection;

an inverting part that inverts the summation signals based on the control of the mode selecting part and generates a plurality of inversion signals;

a decoding part that decodes the summation signals or the inversion signals and generates a decoding signal;

a sensing part that senses an external luminance level and generates a preliminary sensing current; and a smoothing part integrating the preliminary sensing current in the each sensing period and generating the photo sensing voltage.

2. The apparatus of claim 1, wherein the summing part comprises:

a plurality of summing circuits that sum the photo sensing signal and generate the summation signals; and a distributing circuit that distributes the summation signals in each of the periods to the summing circuits, in sequence.

3. The apparatus of claim 2, wherein there are n summing circuits and n summation signals, and the number of the sensing periods is 3n, wherein n is a natural number.

4. The apparatus of claim 1, wherein the mode selecting part is in a transmissive mode, and the decoding part decodes the inversion signals and outputs a decoding signal.

5. The apparatus of claim 1, wherein the mode selecting part is in a transflective mode, and the decoding part decodes the summation signals and outputs a decoding signal.

6. An apparatus for adjusting luminance, comprising:

a comparing part that compares a photo sensing voltage with a reference voltage in each of a plurality of sensing periods and generates a photo sensing signal;

a summing part that sums the photo sensing signal during the sensing periods and generates a plurality of summation signals;

a decoding part that decodes the summation signals and outputs a decoding signal;

a mode selecting part that controls an application of the decoding signal based on a mode selection; and an inverting part that inverts the decoding signal based on the control of the mode selecting part and generates an inversion signal.

7. The apparatus of claim 6, wherein the mode selecting part is in a transmissive mode, and a level of a driving current is determined by the inversion signal.

8. The apparatus of claim 6, wherein the mode selecting part is in a transflective mode, and a level of a driving current is determined by the decoding signal.

9. A display device comprising:

a display panel that displays an image;

a backlight assembly disposed under the display panel that supplies the display panel with light; and a luminance adjusting unit including:

a comparing part that compares a photo sensing voltage with a reference voltage in each of a plurality of sensing periods and generates a photo sensing signal;

a summing part that sums the photo sensing signal during the sensing periods and generates a plurality of summation signals;

a mode selecting part that controls an application of the summation signals based on a mode selection;

an inverting part that inverts the summation signals based on the control of the mode selecting part and generates a plurality of inversion signals; and a driving element that controls a driving current of the backlight assembly based on the summation signals or the inversion signals.

10. The display device of claim 9, wherein the luminance adjusting unit further comprises a sensing part that senses an external luminance level on the display panel and generates the photo sensing voltage.

11. The display device of claim 10, wherein the sensing part is provided on an array substrate of the display panel.

12. The display device of claim 11, wherein the luminance adjusting unit is directly formed on the array substrate.

13. The display device of claim 9, wherein the backlight assembly comprises:

a light source unit generating light based on the driving current; and a light-guiding plate adjacent to the light source unit guiding the light generated from the light source unit toward the display panel.

14. A method of adjusting luminance, comprising:

sensing an external luminance level of a display device and generating a preliminary sensing current;

integrating the preliminary sensing current in each of a plurality of sensing periods and generating a photo sensing voltage;

comparing the photo sensing voltage with a reference voltage in each of the sensing periods and generating a photo sensing signal;

summing the photo sensing signal during the sensing periods and generating a plurality of summation signals;

inverting the summation signals based on a mode selection and generating a plurality of inversion signals; and decoding the summation signals or the inversion signals and outputting a decoding signal.

15. The method of claim 14, further comprising generating a driving current having a level corresponding to the decoding signal.

16. The method of claim 14, wherein the summation signals are generated by:

distributing the photo sensing signal in each of the sensing periods, in sequence; and summing the distributed photo sensing signal.

17. The method of claim 14, wherein the summation signals or the inversion signals are decoded by:

decoding the summation signals when the mode selection is in a transflective mode.

18. The method of claim 14, wherein the summation signals or the inversion signals are decoded by:

decoding the inversion signals when the mode selection is in a transmissive mode.

19. A method of adjusting luminance, comprising:

sensing an external luminance level of a display device and generating a preliminary sensing current;

integrating the preliminary sensing current in each of a plurality of sensing periods and generating a photo sensing voltage;

comparing the photo sensing voltage with a reference voltage in each of the sensing periods and generating a photo sensing signal;

summing the photo sensing signal during the sensing periods and generating a plurality of summation signals;

decoding the summation signals and outputting a decoding signal;

inverting the decoding signal based on a mode selection and generating an inversion signal; and generating a driving current having a level corresponding to the decoding signal or the inversion signal.

20. The method of claim 19, wherein the driving current is generated by determining the level of the driving current based on the decoding signal when the mode selection is a transflective mode.

21. The method of claim 19, wherein the driving current is generated by determining the level of the driving current based on the inversion signal when the mode selection is a transmissive mode.

* * * * *